US009111744B2

(12) United States Patent
Brauner et al.

(10) Patent No.: US 9,111,744 B2
(45) Date of Patent: Aug. 18, 2015

(54) HIGH-PRESSURE DISCHARGE LAMP WITH STARTING AID

(75) Inventors: Thomas Brauner, Berlin (DE); Johannes Buttstaedt, Falkensee (DE); Sascha Piltz, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/389,450

(22) PCT Filed: Jul. 26, 2010

(86) PCT No.: PCT/EP2010/060768
§ 371 (c)(1), (2), (4) Date: Feb. 8, 2012

(87) PCT Pub. No.: WO2011/018327
PCT Pub. Date: Feb. 17, 2011

(65) Prior Publication Data

US 2012/0139413 A1 Jun. 7, 2012

(30) Foreign Application Priority Data

Aug. 14, 2009 (WO) ..... PCT/EP2009/060551
Sep. 30, 2009 (DE) ..... 20 2009 013 108 U

(51) Int. Cl.
*H01J 61/54* (2006.01)
*H01J 61/34* (2006.01)

(52) U.S. Cl.
CPC ..... *H01J 61/547* (2013.01); *H01J 61/34* (2013.01)

(58) Field of Classification Search
CPC ..... H01J 5/32–5/62
USPC ..... 313/623, 581, 601, 603, 607
See application file for complete search history.

(56) References Cited

U.S. PATENT DOCUMENTS

| | | | | |
|---|---|---|---|---|
| 5,825,129 | A * | 10/1998 | Van der Leeuw et al. | 313/634 |
| 6,002,197 | A * | 12/1999 | Tanaka et al. | 313/113 |
| 6,713,961 | B2 * | 3/2004 | Honda et al. | 313/607 |
| 2003/0076041 | A1 * | 4/2003 | Honda et al. | 313/634 |
| 2008/0303402 | A1 | 12/2008 | Li et al. | |

FOREIGN PATENT DOCUMENTS

| | | | |
|---|---|---|---|
| EP | 0443964 | A1 | 8/1991 |
| EP | 967631 | A | 12/1999 |
| EP | 0922296 | B1 | 3/2002 |
| EP | 1398824 | A | 3/2004 |
| WO | 9848447 | A1 | 10/1998 |
| WO | 0077826 | A1 | 12/2000 |
| WO | 2008044197 | A2 | 4/2008 |

* cited by examiner

*Primary Examiner* — Karabi Guharay
*Assistant Examiner* — Nathaniel Lee

(57) ABSTRACT

A high-pressure discharge lamp having an ignition aid, mounted in an outer bulb, wherein the discharge vessel comprises two ends having seals in which electrodes are mounted and wherein a frame having a clip wire retains the discharge vessel in the outer bulb. The clip wire is bent toward the seal of the opposite pole electrode until the bent part formed thereby acts as an ignition aid.

7 Claims, 7 Drawing Sheets

HIGH-PRESSURE DISCHARGE LAMP WITH STARTING AID

RELATED APPLICATIONS

The present application is a national stage entry according to 35 U.S.C. §371 of PCT application No.: PCT/EP2010/060768 filed on Jul. 26, 2010, which claims priority from PCT application No.: PCT/EP2009/060551 filed on Aug. 14, 2009, and German application No.: 202009013108.4 filed on Sep. 30, 2009.

FIELD OF THE INVENTION

The invention relates to a high-pressure discharge lamp, and in particular high-pressure discharge lamps for general lighting or for photo-optical purposes.

BACKGROUND

WO 2008/044197 discloses a high-pressure discharge lamp including a ceramic discharge vessel, in which a starting aid projects from a long frame wire. The starting aid is a separate wire piece, which extends at the height of a capillary in the direction of the discharge vessel.

Such an arrangement has the disadvantage that installation of the starting aid involves considerable effort and cost.

SUMMARY OF THE INVENTION

The present invention addresses the problem of providing a high-pressure discharge lamp whose starting is assisted by simple economical means.

This applies in particular to metal halide lamps, wherein the material of the discharge vessel can be ceramic or quartz glass.

The seals of the discharge vessel can be embodied by means of fusing-in or pinching.

According to various embodiments, part of the frame is now directly bent in such a way that a bent part extends in the direction of a seal, generally a capillary or pinch portion, and specifically that seal which has the opposite electrical polarity to the cited frame. The bent part has two supply parts and a peak part, which develops the main effect as a starting aid. The two supply parts are bent relative to the long current conductor or so-called support wire of the frame. The peak part is arranged in the vicinity of the seal. In the case of ceramic discharge vessels, the peak part is preferably arranged in a region where the stem of the electrode sits in the capillary but is separated from the wall of the capillary.

The voltage that is required to start high-pressure discharge lamps increases with the length of service life. Old lamps having conventional starting devices can therefore fail to start. However, the starting capability must be guaranteed over the entire service life, and this is ensured by the inventive arrangement without thereby incurring significant additional costs.

Various approaches to the solution have previously been applied.

a) A radioactive gas such as e.g. Kr85 is admixed to the burner filler gas. The radioactivity causes an ionization of the filler gas, which reduces the breakdown voltage and thus ensures the starting capability. However, the use of radioactivity is increasingly limited by statutory regulation.

b) A so-called UV enhancer is integrated into the outer envelope. This consists of a miniaturized discharge tube which emits UV radiation when the starting voltage is applied. This UV radiation likewise causes an ionization of the burner filler gas, thereby ensuring the starting capability; see EP-A 922296.

c) From the support wire, a wire is wound around the capillary containing the electrode of opposite polarity. When the starting voltage is applied, a dielectrically impeded discharge therefore occurs in the region of this electrode, ionizing the burner filler gas and reducing the starting voltage; see e.g. EP-A 967631.

The present arrangement takes up the principle of the dielectrically impeded discharge, but simplifies it considerably.

The support wire is configured such that it runs as closely as possible to or touches the seal containing the electrode of opposite polarity. A dielectrically impeded discharge occurs there, as in the case of the wire windings cited under c), ionizing the filler gas in the burner and allowing a dielectric breakdown. Unlike previous solutions, this approach to the solution is configured such that no additional component is required as a starting aid, the support wire instead assuming the additional functionality of a starting aid by virtue of its bent shape.

The support wire can lie against, overlap or wrap around the seal. A geometry that is as simple as possible and does not restrict manufacturing is nonetheless preferred.

The peak part of the support wire preferably has a minimal distance from the current conducting electrode of opposite polarity, wherein the location of said minimal distance should be as close as possible to the actual discharge vessel.

According to the invention, radioactive admixtures are no longer required. In the context of lamps having a socket on only one side, a support wire running along the capillary is very easy to realize in terms of manufacturing, and is considerably easier to realize than a wire winding around the capillary. Moreover, the support wire does not require additional space in the outer envelope, unlike UV enhancers. The risk of the starting aid losing its functionality or becoming displaced due to a poor joint connection to the support wire during the service life is practically negligible, since it is not a separate component, but an integral part of the support wire.

The seals of the discharge vessel are often designed as a pinch portion or capillary, though fusing-in is also possible.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

PREFERRED EMBODIMENTS OF THE INVENTION

The following detailed description refers to the accompanying drawings that show, by way of illustration, specific details and embodiments in which the invention may be practiced.

Figure 1:
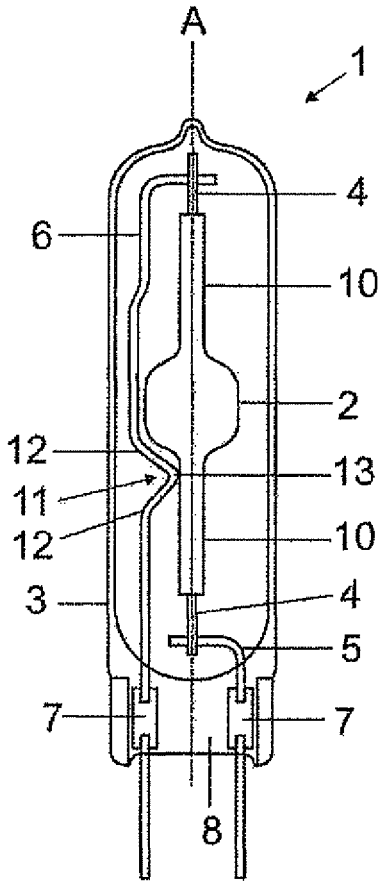
FIG. 1 shows a high-pressure discharge lamp with starting aid, first exemplary embodiment.

FIG. 1 schematically shows the structure of a high-pressure discharge lamp 1. It includes a discharge vessel 2, which is contained in an outer envelope 3. The external conductors 4 of the discharge vessel, which contact the electrodes in the interior, are connected to two frame wires 5 and 6. A short frame wire 5 leads to a first foil 7 in a pinch portion 8 of the outer envelope. A long frame wire 6, frequently referred to as a support wire, leads to a second foil 7 in the pinch portion 8. The discharge vessel 2 has a capillary 10 at both ends, this being known per se, and a filling which consists of an ionizable gas, usually argon or xenon, mercury and metal halides, and is likewise known per se. Two electrodes are situated opposite to each other in the interior of the discharge vessel, being likewise known per se, and are not shown here.

The support wire 6 runs along the discharge vessel, essentially parallel to the axis A thereof, as far as the second capillary 10 (this being remote from the pinch portion 8), where it is connected to the conductor 4.

In the region of the first capillary 10, the support wire 6 is bent inwards towards the capillary in a plane, such that the resulting bent part 11 is shaped like a V. This results in two straight supply parts 12 and a peak part 13, specifically the bend between the supply parts 12. The bent part is situated on a plane. The supply parts 12 are bent obliquely, in particular at 30° to 60°, relative to the support wire 6 or axis A. An angle of 45° is typical. This exemplary embodiment conserves materials and is the simplest and most economical to manufacture. It is astonishing that this simple arrangement is already sufficient to support the starting. It is nonetheless important for the peak part to be arranged as far forward as possible in the region of the capillary, preferably in the region of the first 20% of the length of the capillary.

Figure 2:
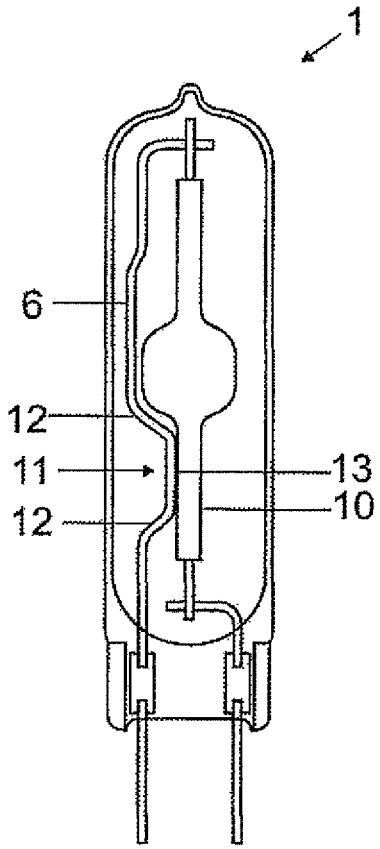
FIG. 2 shows a high-pressure discharge lamp with starting aid, second exemplary embodiment.

FIG. 2 shows an exemplary embodiment in which the bent part 11 is shaped in the form of a U. The two supply parts 12 here are bent at approximately 45° to 90° relative to the support wire 6. The peak part 13 is bent at 90° to 135° relative to the supply parts and runs parallel to the capillary 10. A greater volume in the discharge vessel is ionized in this way. The peak part 13 here is designed to project inwards at least in the region of the first 20% of the length of the capillary and/or occupy as much of this region as possible.

Figure 3:
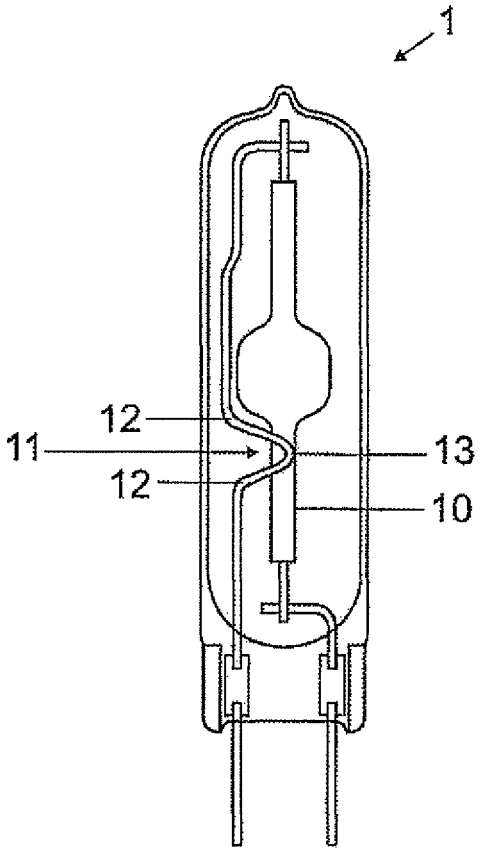
FIG. 3 shows a high-pressure discharge lamp with starting aid, third exemplary embodiment.

FIG. 3 shows a third exemplary embodiment, in which the basic arrangement is similar to that in FIG. 1. The bent part 11 is V-shaped. However, the plane of the bent part is not selected so as to seek the shortest connection in the direction of the capillary 10, as is the case in FIG. 1. Instead, the plane of the bent part 11 is selected such that it is diverted tangentially past the capillary 10. The peak part 13 preferably lies in the projection of the capillary 10 in side view, as illustrated in FIG. 3. This arrangement has the advantage that a region having inhomogeneous field strengths can act in a relatively large volume of the capillary 10.

Figure 4:
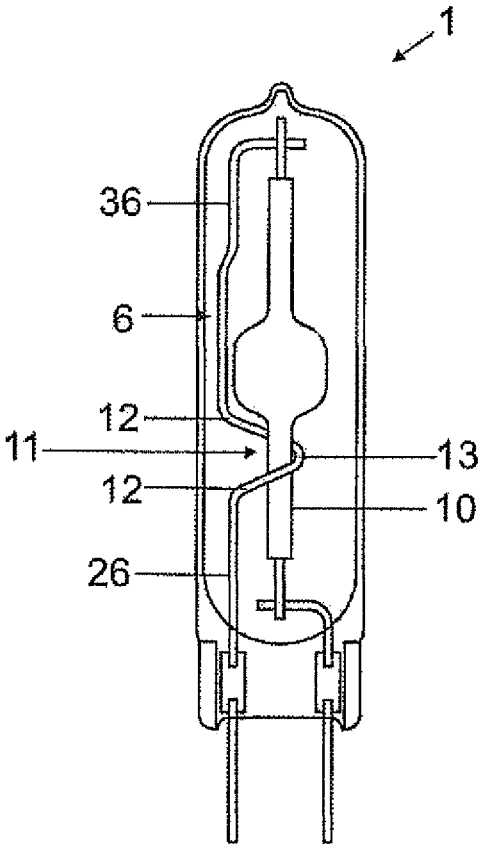
FIG. 4 shows a high-pressure discharge lamp with starting aid, fourth exemplary embodiment.

FIG. 4 shows a fourth exemplary embodiment, in which the bent part 11 does not lie on a plane. Instead, the bent part 11 is routed around the capillary 10 in the manner of a screw thread or spiral, wherein the bent part 11 resembles a semicircle without a structurally distinct peak part 13. Instead, the peak part 13 here is functionally produced by the point which is closest to the capillary 10.

A modification of this design can combine elements of the exemplary embodiment as per FIG. 1 with elements from FIG. 4, in that the bent part is bent into a V shape in principle, but the two supply parts do not lie on a plane, the peak part instead being routed around the capillary as in FIG. 4. In this case, the support wire 6 can likewise be bent such that a first part 26, which is near to the pinch portion, and a second part 36, which is remote from the pinch portion, are so positioned as to be parallel to each other. The bent part 11 sits between both parts.

In general, the minimal distance between bent part 11 and capillary 10 is preferably no more than 1 mm.

Figure 5:
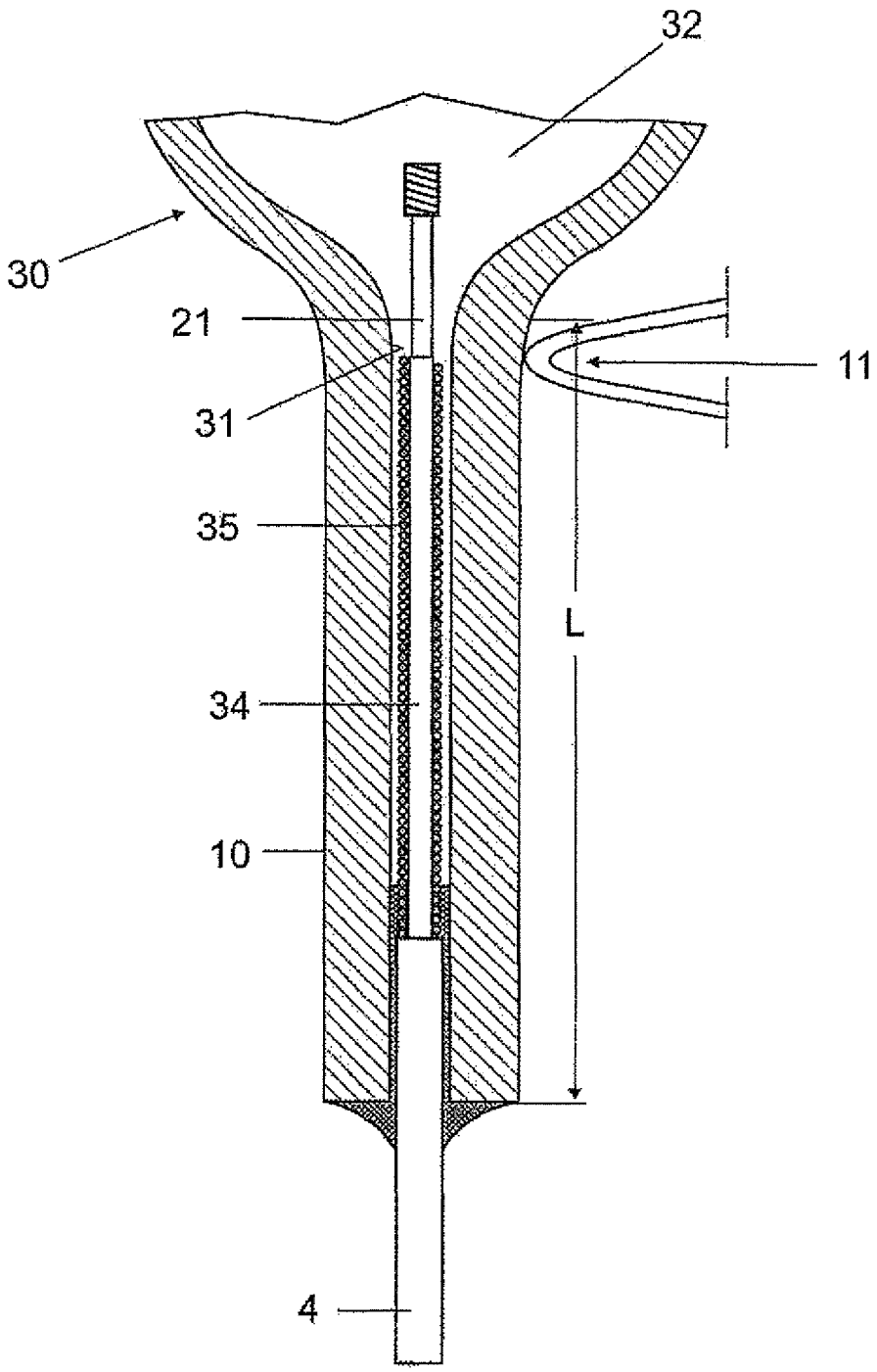
FIG. 5 shows a high-pressure discharge lamp with starting aid, fifth exemplary embodiment.

FIG. 5 shows a detail of a ceramic discharge vessel 30. It is important that the starting aid, represented by the bent part 11, should have the shortest distance to the capillary 10 in that region in which the stem 21 of the electrode sits in the capillary 10, but that a relatively large distance to the wall 31 of the capillary should be present, thereby ensuring the presence here of a relatively large ionizable volume. This starting aid should generally sit in the first 20% of the length L of the capillary, such that part of the inhomogeneous field strength extends as far as possible into the discharge volume 32. The rear part of the stem or the leadthrough 34 is often surrounded by a spiral winding 35 in order to minimize the dead volume there.

Figure 6:
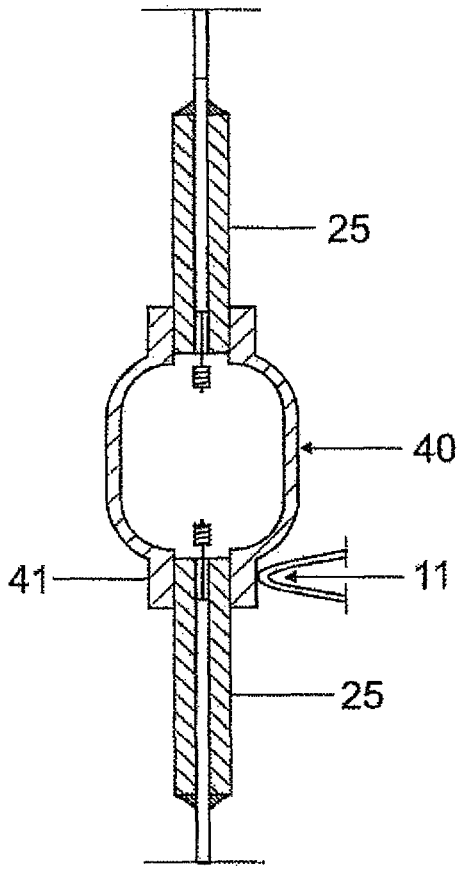
FIG. 6 shows a high-pressure discharge lamp with starting aid, sixth exemplary embodiment.

FIG. 6 shows a further exemplary embodiment of a discharge vessel 40 with end 41, wherein the capillary is represented by a separate end plug 25. Here too, it is important for the bent part 11 to sit as far forward as possible, at the height of the end 41 of the discharge vessel here.

Figure 7:
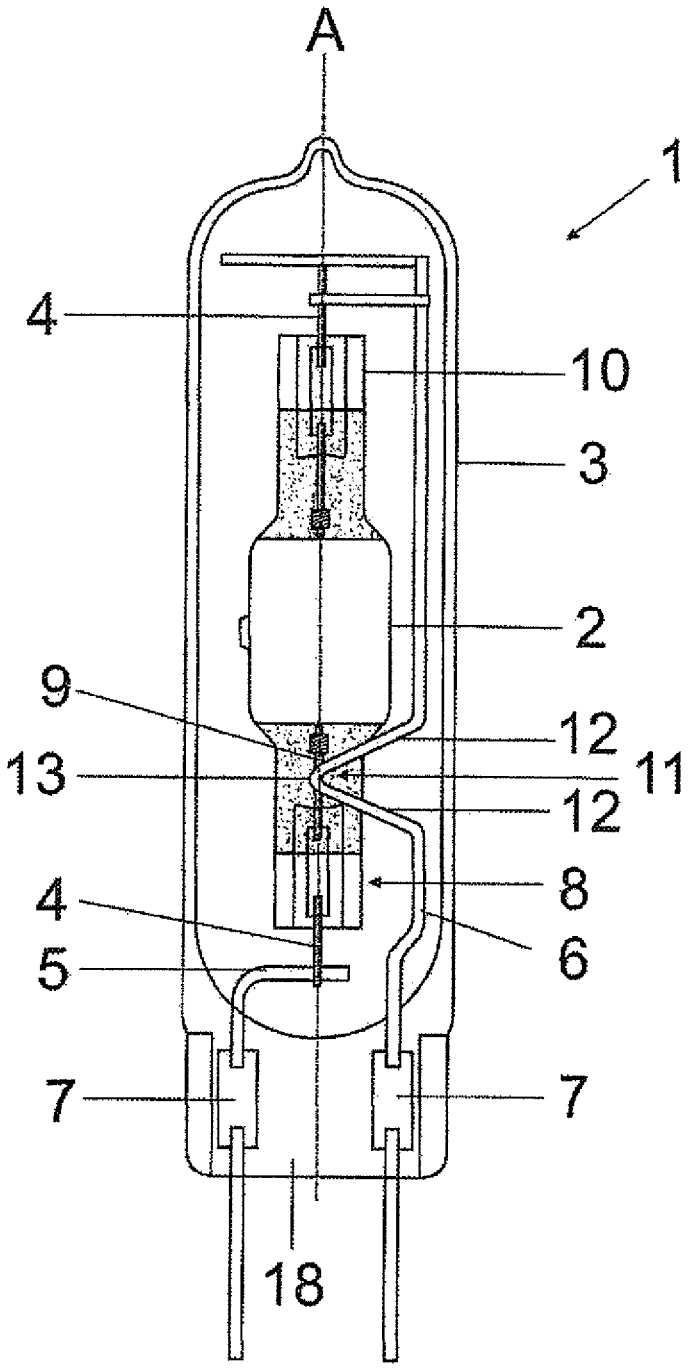
FIG. 7 shows a high-pressure discharge lamp with starting aid, seventh exemplary embodiment.

FIG. 7 schematically shows the structure of a high-pressure discharge lamp 1. It includes a discharge vessel 2 made of quartz glass, which is contained in an outer envelope 3. The external conductors 4 of the discharge vessel, which contact electrodes in the interior, are connected to two frame wires 5 and 6. A short frame wire 5 leads to a first foil 7 in a pinch portion 8 of the outer envelope. A long frame wire 6, frequently referred to as a support wire, leads to a second foil 7 in the pinch portion 8. The discharge vessel 2 has a filling which consists of an ionizable gas, usually argon or xenon, mercury and metal halides, and is likewise known per se. Two electrodes 9 are situated opposite each other in the interior of the discharge vessel, this being likewise known per se.

In this case, it is important that the filling should contain a minimum of Na (which is otherwise usually present as an iodide), and should preferably be Na-free. Use is preferably made of rare-earth metal halides, often in conjunction with thallium halide or similar.

The support wire 6 runs along the discharge vessel and essentially parallel to the axis A thereof, as far as the second pinch portion 10 (this being remote from the first pinch portion 8), where it is connected to the conductor 4.

In the region of the end of the discharge vessel and near to the first pinch portion 8, the support wire 6 is bent towards the pinch portion in a plane, such that the resulting bent part 11 is shaped like a V. This results in two supply parts 12, which are so arranged as to be straight but oblique relative to the axis, and an angle part 13, specifically the bend between the supply parts 12. The bent part lies on a plane. The supply parts 12 are bent obliquely, in particular at 30° to 60°, relative to the support wire 6 or axis A. An angle of 45° is typical. This exemplary embodiment conserves materials and is the simplest and most economical to manufacture. It is astonishing that this simple arrangement is already sufficient to support the starting.

Also possible is an exemplary embodiment in which the bent part is shaped in the form of a U. The two supply parts here are bent at approximately 45° to 90° relative to the support wire 6. The angle part is bent at 90° to 135° relative to the supply parts and runs parallel to the pinch portion. A greater volume in the discharge vessel is ionized thus. The angle part should project at least into the region of the pinch portion here.

Also possible is a third exemplary embodiment, in which the basic arrangement is similar to that in FIG. 1. The bent part is V-shaped. However the plane of the bent part is not selected so as to seek the shortest connection in the direction of the pinch portion, as is the case in FIG. 1. Instead, the plane of the bent part is selected such that it is diverted tangentially past the pinch portion. The angle part preferably lies in the projection of the pinch portion in side view. This arrangement has the advantage that a region having inhomogeneous field strengths can act in a relatively large volume.

Also possible is a fourth exemplary embodiment, in which the bent part does not lie on a plane. Instead, the bent part is routed around the pinch portion in the manner of a screw thread or spiral, wherein the bent part resembles a semicircle without a structurally distinct angle part. Instead, the angle part here is functionally produced by the point which is closest to the pinch portion.

A modification of this design can combine elements of the exemplary embodiment as per FIG. 1 with elements of the other exemplary embodiments, in that the bent part is bent into a V shape in principle, but the two supply parts do not lie on a plane, the peak part instead being routed around the capillary. In this case, the support wire can be bent such that a first part, which is near to the pinch portion, and a second part, which is remote from the pinch portion, are so positioned as to be parallel to each other. The bent part sits between both parts.

The bent part preferably features two supply parts and an angle part, also called a peak part, between them.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp with starting aid, comprising a discharge vessel which is contained in an outer envelope, wherein the discharge vessel features two ends having seals in which electrodes are fastened, wherein a frame comprising a support wire holds the discharge vessel in the outer envelope, wherein the support wire is bent towards the seal of the electrode of opposite polarity to the extent that the bent part thus formed acts as a starting aid, wherein the bent part has a minimal distance to a capillary, wherein the bent part includes a first and second supply part and a peak part, the first supply part projecting inwards in the region of the first 20% of the length of the capillary into the straight peak part, the straight peak part running parallel and alongside the capillary until projecting outwards to the second supply part, wherein the straight portion runs parallel and alongside the capillary until at least 20% of the length of the capillary.

2. The high-pressure discharge lamp as claimed in claim 1, wherein the first and second supply parts are bent at an angle.

3. The high-pressure discharge lamp as claimed in claim 1, wherein the bent part lies on a plane with the support wire.

4. The high-pressure discharge lamp as claimed in claim 1, wherein the seal of the electrode of opposite polarity comprises a pinch portion.

5. The high-pressure discharge lamp as claimed in claim 1, wherein the discharge vessel has a metal halide filling, which is largely free of Na.

6. The high-pressure discharge lamp as claimed in claim 1, wherein the seal of the electrode of opposite polarity is the capillary.

7. The high-pressure discharge lamp as claimed in claim 6, wherein the capillary is an integral part of the discharge vessel.

* * * * *